US008499391B2

(12) United States Patent
Jung

(10) Patent No.: US 8,499,391 B2
(45) Date of Patent: Aug. 6, 2013

(54) LAUNDRY MACHINE AND METHOD OF CONTROLLING OPERATION THEREOF

(75) Inventor: Youn Su Jung, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1055 days.

(21) Appl. No.: 12/501,997

(22) Filed: Jul. 13, 2009

(65) Prior Publication Data

US 2010/0005598 A1 Jan. 14, 2010

(30) Foreign Application Priority Data

Jul. 14, 2008 (KR) ..... 10-2008-0067963

(51) Int. Cl.
*D06F 33/02* (2006.01)
*D06F 35/00* (2006.01)
*D06F 37/20* (2006.01)

(52) U.S. Cl.
USPC ..... 8/159

(58) Field of Classification Search
USPC ..... 8/158, 159; 68/12.02, 12.06
See application file for complete search history.

(56) References Cited

U.S. PATENT DOCUMENTS

| | | | | |
|---|---|---|---|---|
| 5,257,516 | A | 11/1993 | Hossfield | |
| 5,930,855 | A * | 8/1999 | Vande Haar et al. | 8/159 |
| 6,134,926 | A * | 10/2000 | Vande Haar et al. | 68/12.06 |
| 6,477,867 | B1 * | 11/2002 | Collecutt et al. | 68/12.06 |
| 6,530,100 | B2 * | 3/2003 | Conrath | 8/159 |
| 2002/0194682 | A1 | 12/2002 | Conrath | |
| 2007/0294839 | A1 * | 12/2007 | Cho | 8/158 |
| 2009/0241605 | A1 * | 10/2009 | Moore | 68/12.06 |

FOREIGN PATENT DOCUMENTS

| | | | |
|---|---|---|---|
| CN | 1069133 | A | 2/1993 |
| DE | 1435025 | A1 | 7/1969 |
| EP | 1 741 822 | A1 | 1/2007 |
| EP | 1 897 987 | A1 | 3/2008 |
| JP | 2007-143610 | A | 6/2007 |
| WO | WO 2008012032 | A1 * | 1/2008 |
| WO | WO 2008028566 | A1 * | 3/2008 |

* cited by examiner

*Primary Examiner* — Joseph L Perrin
(74) *Attorney, Agent, or Firm* — Birch, Stewart, Kolasch & Birch, LLP

(57) ABSTRACT

Disclosed is a laundry machine, which washes laundry using rotation of a drum, and a method of controlling an operation thereof. The laundry machine is operated in consideration of information about a floor, on which the laundry machine is installed, and thus the optimized operation of the laundry machine is performed according to a state of the floor, thereby minimizing noise and sagging of the floor due to vibration.

6 Claims, 7 Drawing Sheets

LAUNDRY MACHINE AND METHOD OF CONTROLLING OPERATION THEREOF

This application claims the benefit of Korean Patent Application No. 10-2008-0067963, filed on Jul. 14, 2008, which is hereby incorporated by reference as if fully set forth herein.

BACKGROUND OF THE INVENTION

1. Field of the Invention

The present invention relates to a laundry machine and a method of controlling an operation thereof, and more particularly, to a method of controlling an operation of a laundry machine, in which rotation of a drum is controlled according to a floor, on which the laundry machine is mounted.

2. Discussion of the Related Art

In general, a laundry machine refers to an apparatus of washing and/or drying laundry. Such a laundry machine is provided with a space formed therein to receive laundry, and performs an operation to treat the laundry using various components installed therein under the condition that the laundry is put into the space.

The laundry machine generally includes a drum rotatably installed therein, and treats laundry put into the drum by rotation of the drum.

In case of washing laundry, the laundry is washed mainly using a difference in elevation of the laundry according to the rotation of the drum. In case of dehydrating laundry, water contained in the laundry is removed using the centrifugal force according to the high-speed rotation of the drum. In case of drying laundry, moisture contained in the laundry is removed by supplying hot air to the laundry simultaneously with the rotation of the drum.

Therefore, the laundry machine is controlled such that rotational speed of the drum is adjusted according to functions to be performed so as to treat laundry contained in the drum.

As the drum performs a rotating operation, the laundry machine generates vibration. The generated vibration is transmitted to a floor, on which the laundry machine is mounted. In this case, the vibration generated from the laundry machine may cause many problems according to a state of the floor (for example, hardness of the floor).

First, in case that the floor, on which the laundry machine is mounted, is excessively hard, the floor cannot absorb the vibration and thus generates excessive noise. For example, if the laundry machine is mounted on a floor having a high hardness, such as a floor made of concrete or tile, the vibrating laundry machine may collide with the floor, and cause loud noise.

Further, in case that the floor, on which the laundry machine is mounted, is excessively soft, the floor may sag due to force transmitted by the vibration and thus deviate the current position of the laundry machine from an initial set position. For example, if the laundry machine is mounted on a floor having a low hardness, such as a floor made of wood or laminated paper, the floor may be deformed or sag due to continuous vibration.

SUMMARY OF THE INVENTION

Accordingly, the present invention is directed to a laundry machine and a method of controlling an operation thereof.

An object of the present invention is to provide a laundry machine, in which rotation of a drum is controlled according to a state of the floor to prevent generation of noise with the floor and sagging of the floor, and a method of controlling an operation of the laundry machine.

To achieve this object and other advantages and in accordance with the purpose of the invention, as embodied and broadly described herein, a method of controlling an operation of a laundry machine to treat laundry using a rotational force of a drum includes judging information about a floor, on which the laundry machine is mounted, and controlling a rotational speed of the drum according to the information about the floor so as to treat the laundry.

If it is determined in the judgment that the information about the floor is input, the laundry machine may be controlled according to the input information about the floor.

If it is determined in the judgment that the information about the floor are not input, the method may further include displaying kinds of the floor, on which the laundry machine can be mounted, and standing by a user's selection out of the displayed kinds of the floor.

If the information about the floor exceeds a predetermined range, maximum rotational speed and acceleration/deceleration of the drum may be controlled in the control of the rotational speed of the drum.

If the information about the floor does not reach a predetermined range, maximum rotational speed and acceleration/deceleration of the drum may be controlled in the control of the rotational speed of the drum.

If a hardness of the floor is more than a first set hardness, a maximum rotational speed of the drum may be restricted.

If a hardness of the floor is less than a second set hardness, maximum rotational speed and operating time of the drum may be restricted.

The control of the rotational speed of the drum may include dehydrating the laundry.

If the judged hardness of the floor is more than a first set hardness, a maximum rotational speed of the drum may be restricted in the dehydration of the laundry.

The method may further include rotating the drum at a lower rotational speed than the maximum rotational speed for a designated time prior to acceleration of the drum to the maximum rotational speed.

If the judged hardness of the floor is less than a second set hardness, maximum rotational speed and operating time of the drum may be restricted in the dehydration of the laundry.

In the judgment of the information about the floor, a hardness of the floor may be judged using a hardness according to the kind of the floor, which is selected in the initial mounting of the laundry machine.

In the judgment of the information about the floor, a hardness of the floor may be judged using a hardness value according to the kind of the floor, which is input by a user's selection.

In another aspect of the present invention, a laundry machine includes a main body forming an external appearance of the laundry machine and mounted on a floor, a drum provided in the main body to perform washing by a rotational force, a control panel to set information about the floor, on which the main body is mounted, and a controller to control a rotating state of the drum rotated by a driving unit according to setting based on a hardness of the floor so as to control transmission of vibration between the main body and the floor.

The control panel may include buttons to input kinds of the floor, and a display unit to display the kinds of the floor.

The buttons may include a floor button to allow the kinds of the floor to be displayed on the display unit, and a set button to select one out of the displayed kinds of the floor.

The controller may control an operation of the driving unit by comparing a hardness of the floor according to information of the floor, set by a user, with a predetermined set hardness.

The controller may restrict a maximum rotating speed of the drum, if a hardness of the floor is more than a first set hardness.

The controller may restrict maximum rotating speed and operating time of the drum, if a hardness of the floor is less than a second set hardness.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a laundry machine and a method of controlling an operation thereof in accordance with a preferred embodiment of the present invention will be described in detail with reference to the accompanying drawings.

In this embodiment, the present invention is applied to a washing machine including a drum. However, the present invention is not limited to a method of controlling an operation of a drum washing machine, and it is apparent that the present invention may be applied to all laundry machines treating laundry through rotation of a drum.

Figure 1:
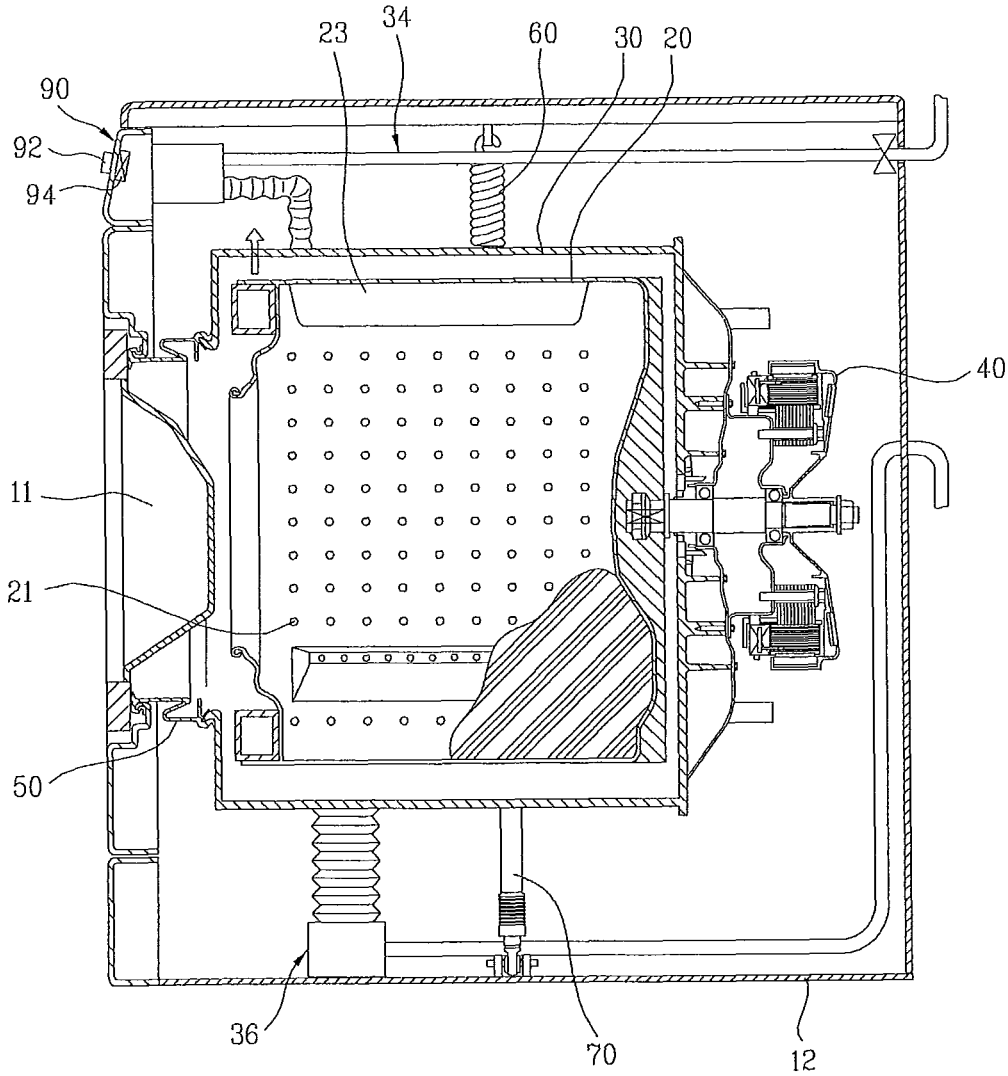
FIG. 1 is a longitudinal-sectional view illustrating the inside of a laundry machine in accordance with an embodiment of the present invention.

FIG. 1 is a longitudinal-sectional view illustrating the inside of a laundry machine in accordance with an embodiment of the present invention. Although this embodiment exemplarily illustrates a front loading type laundry machine, in which a drum is rotated about a horizontal axis, the present invention is not limited thereto. Further, the present invention may be applied to a top loading type laundry machine, in which a drum is installed at the upper part and is rotated about a vertical axis by a driving unit provided under the drum.

With reference to FIG. 1, the laundry machine in accordance with this embodiment includes a cabinet 12 forming the external appearance of the laundry machine, a tub 30 provided in the cabinet 12 to contain water, a drum 20 rotatably installed in the tub 30 to receive laundry, a driving unit 40 installed on the rear portion of the tub 30 to rotate the drum 20, and a door 11 provided at the front surface of the cabinet 12 to open and close an opening, through which the laundry is put into and taken out of the laundry machine.

The laundry machine in accordance with this embodiment further includes a control panel 90 provided on the upper portion of the front surface of the cabinet 12 and including various buttons to allow a user to control an operation of the laundry machine.

The cabinet 12 forms the external appearance of the laundry machine, and various components, which will be described later, are installed at the inside and outside of the cabinet 12. The door 11 to open and close the opening, through which the laundry is put into and taken out of the laundry machine, is rotatably provided at the front portion of the cabinet 12.

The tub 30 is provided in the cabinet 12 to contain water, and is formed in the shape of a cylindrical case, which is opened toward the door 11 to receive laundry through the door 11. A gasket 50 to seal the tub 30 is provided between the tub 30 and the door 11.

The driving unit 40 to rotate the drum 20 is mounted on the rear surface of the tub 30. The driving unit 40 includes a motor, and rotates the drum 20. The rotational speed of the driving unit 40 is controlled by a controller. The structure and kinds of the driving unit 40 are well known to those skilled in the art that and various modifications and variations can be made to the driving unit 40, and thus a detailed description of the driving unit 40 will be omitted.

The tub 30 is elastically supported by a spring 60 provided at the upper part thereof and a damper 70 provided at the lower part thereof. Therefore, when a vibration generated by the rotation of the drum 20 by the driving unit 40 is transmitted to the cabinet 12 through the tub 30, the vibration is buffered and attenuated by the spring 60 and the damper 70. Thereby, the transmission of the vibration generated by the rotation of the drum 20 to the cabinet 12 is reduced to some degree.

A water supply unit 34 including a water supply hose and a detergent supply device to supply water from an external water source to the inside of the tub 30 is installed on the upper surface of the tub 30. A drain unit 36 including a drain hose and a drain pump to discharge water used to wash and rinse the laundry to the outside of the laundry machine is installed under the lower surface of the tub 30.

The drum 20 is rotatably provided in the tub 30. A plurality of through holes 21 to drain water is formed through the drum 20, and a plurality of lifts 23 to raise the laundry loaded in the drum 20 and then drop the laundry when the drum 20 is rotated 20 is formed on the inner surface of the drum 20.

The laundry machine in accordance with this embodiment further includes a hot air supply device (not shown) to supply hot air to the inside of the drum 20, and a steam supply device (not shown) to supply steam to the inside of the drum 20.

The hot air supply device supplies hot air obtained by heating air to the drum 20, thereby drying the laundry received in the drum 20. The steam supply device supplies steam obtained by heating water to the drum 20, thereby performing refreshing of the laundry in the drum 20, such as removal of wrinkles, removal of smells, and removal of static electricity. Detailed configurations of the hot air supply device and the steam supply device are apparent to those skilled in the art, and thus detailed descriptions of the hot air supply device and the steam supply device will be omitted.

Figure 2:
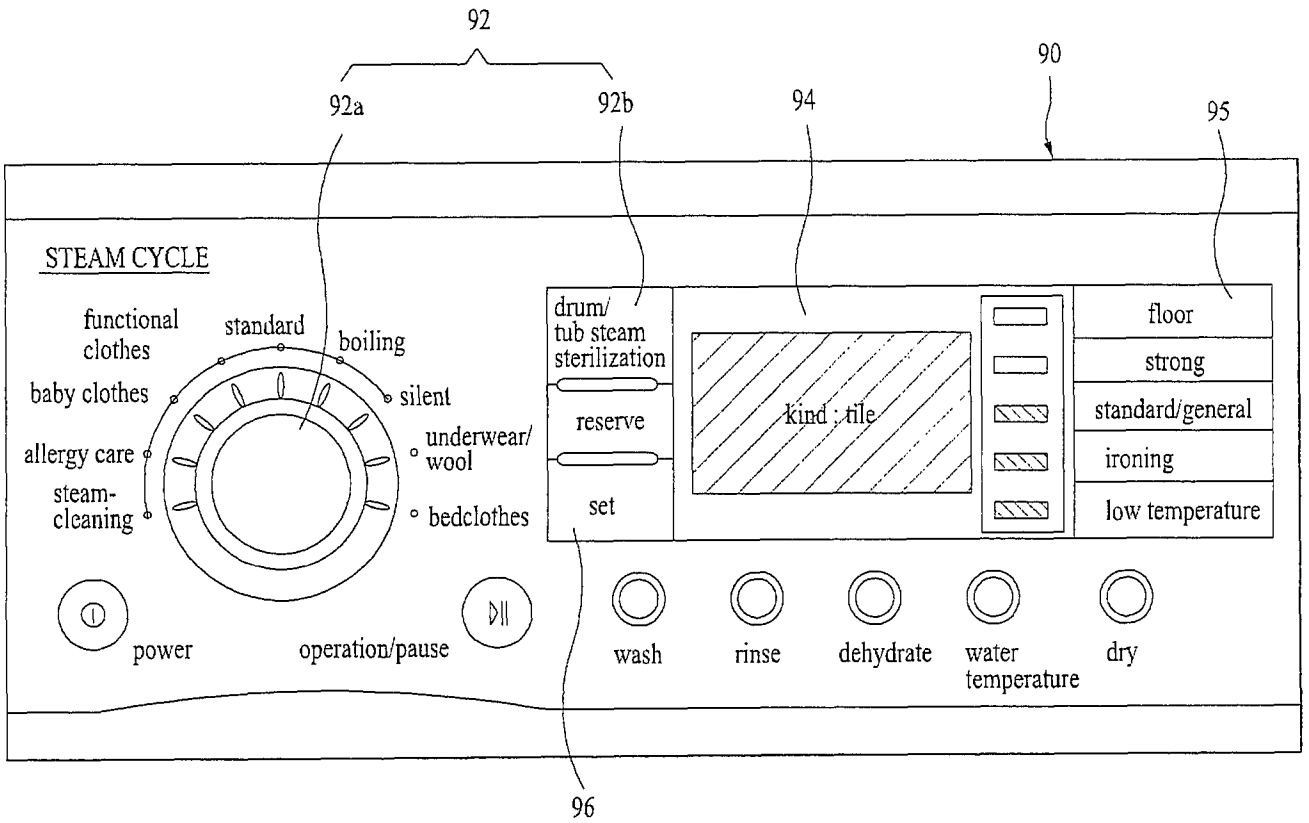
FIG. 2 is a schematic view illustrating a control panel of the laundry machine in accordance with the embodiment of the present invention.

The control panel 90 may be provided on the upper part of the door 11. Now, the control panel 90 will be described with reference to FIG. 2. The control panel 90 includes a control unit 92 to control an operation of the laundry machine, and a display unit 94 to display an operating state of the laundry machine.

A rotary knob 92*a* and a plurality of buttons 92*b* are installed on the control unit 92. The rotary knob 92*a* and the buttons 92*b* serve as input units to operate the laundry machine, and are manipulated by a user in order to select a washing time, reservation, setting, a washing method, a rinsing method, and a dehydrating method, such that the user can input desired washing course and time.

In this embodiment, a state of a floor, on which the laundry machine is mounted, may be input through the control unit 92. For example, kinds of the floor are displayed on the display unit 94 through a floor button 95, separately provided, and one of the displayed kinds of the floor is selected through a set button 96.

The display unit 94 displays information about the laundry machine set up by the control unit 92, and includes a plurality of LEDs and LCDs, which are continuously arranged. The display unit 94 informs the user of various washing information, such as a washing progress state and a remaining time, through switching-on and off of the LEDs and letters or marks on the LCDs.

The display unit 94 in this embodiment may display all kinds of the floor to set a kind of the floor, on which the laundry machine is substantially mounted, from the displayed kinds of the floor. For example, the kinds of the floor, on which the laundry machine can be mounted, such as concrete, tile, wood, and laminated paper, may be sequentially displayed. The display of the kinds of the floor may be operated in connection with the floor button 95 of the control unit 92.

The above-described respective components are controlled by the controller (not shown) such that operations of the components are connected with each other. The controller controls an operation of the driving unit 40 based on the state of the floor set by the user's input, thus controlling a rotational speed of the drum 20. Thereby, vibration generated by the rotation of the drum 20 may be controlled.

The controller stores states of the floor (for example, hardness) according to kinds of the floor, on which the laundry machine is mounted, and a proper state is applied to the laundry machine according to the kind of the floor set by the user's input and thereby the rotational speed of the drum 20 is controlled.

Hereinafter, an operation of the above laundry machine in accordance with this embodiment will be described with reference to the accompanying drawings. Elements and reference numerals, which will be referred to below, will be understood with reference to the above descriptions and drawings.

First, the laundry machine in accordance with this embodiment may require a process of setting a state of the floor, on which the laundry machine is mounted, by input when the laundry machine is initially operated. That is, setting to control operating conditions of the laundry machine according to conditions of the floor, on which the laundry machine is mounted, is required.

Input of the state of the floor may be carried out at a point of time when the laundry machine is mounted on the floor and is initially operated or when a mounting place of the laundry machine is changed, or may be selectively carried out at a user's request.

Figure 3:
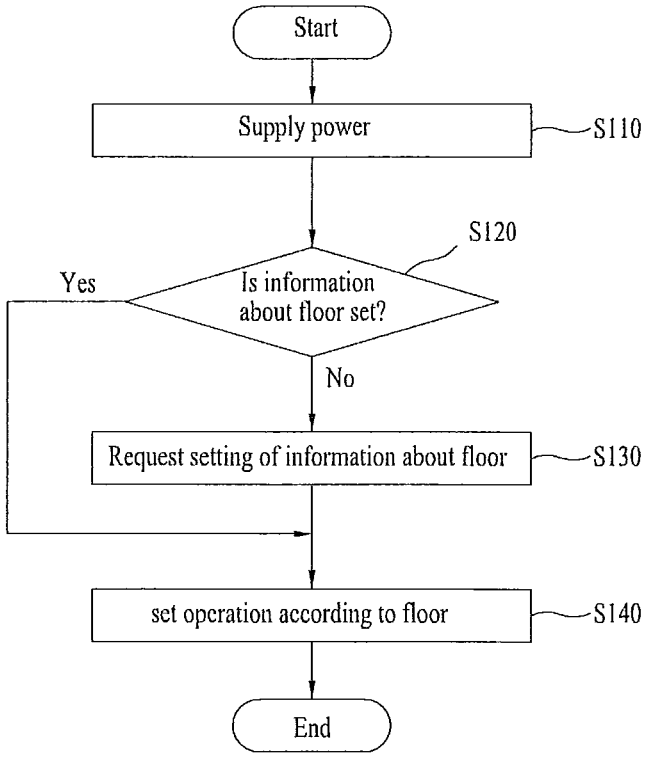
FIG. 3 is a flow chart illustrating a process of setting a floor, on which the laundry machine in accordance with the embodiment of the present invention is mounted.

Hereinafter, with reference to FIG. 3, a process of setting a floor, on which a laundry machine in accordance with an embodiment of the present invention is mounted, will be described. FIG. 3 is a flow chart illustrating the process of setting the floor, on which the laundry machine in accordance with this embodiment is mounted.

First, a user supplies power to the laundry machine through a main power supply (not shown) of the laundry machine, thus supplying the power to the respectively components of the laundry machine (S110). Then, the controller determines whether or not information about the floor, on which the laundry machine is mounted, is set (S120).

In case that it is determined that the information about the floor, on which the laundry machine is mounted, is set, the controller sets an operating state of the laundry machine according to the set information about the floor (S140). On the other hand, in case that it is determined that the information about the floor, on which the laundry machine is mounted, is not set, the display unit 94 displays information about the floor such that the user inputs the information about the floor, on which the laundry machine is mounted (S130).

Here, the controller sequentially displays all kinds of the floor, on which the laundry machine is generally mounted, through the display unit 94, thus allowing the user to select one out of the displayed kinds of the floor. For example, the controller may display the kinds of the floor, such as concrete, tile, wood, and laminated paper.

Thereafter, when the information about the floor is input by the user, the controller sets the operating state of the laundry machine according to the input information about the floor (S140), and stands by a user's operation input.

The above-described setting of the floor may be carried out when the laundry machine is initially mounted. However, after the initial mounting of the laundry machine, the floor may be re-set by a user's manipulation, as occasion demands. In this case, kinds of the floor may be displayed and one out of the displayed kinds of the floor may be selected using the floor button 95 and the set button 96 provided on the control panel 90.

Figure 4:
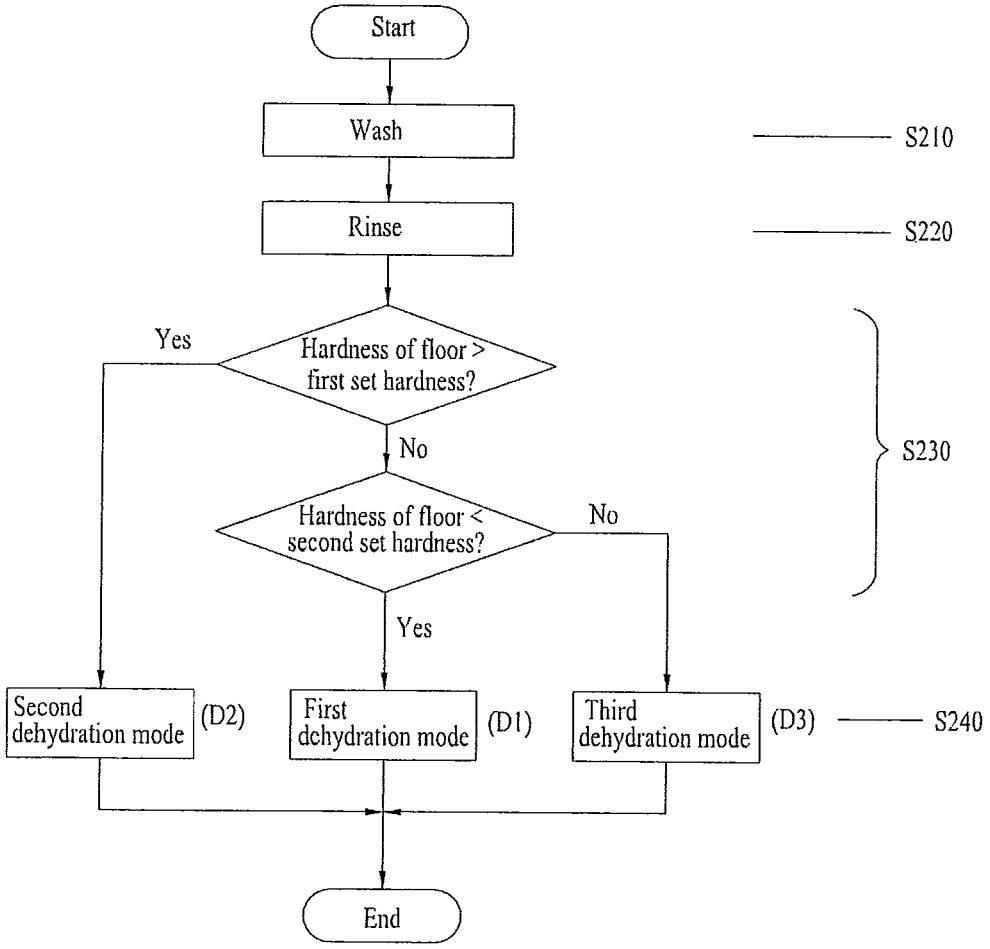
FIG. 4 is a flow chart illustrating a method of an operation of the laundry machine in accordance with the embodiment of the present invention.

FIG. 4 is a flow chart illustrating a method of controlling an operation of a laundry machine in accordance with an embodiment of the present invention. As shown in FIG. 4, when the laundry machine starts an operation under the condition that laundry is put into the laundry machine, the laundry machine sequentially performs washing (S210), rinsing (S220), judging (S230), and dehydrating (S240).

During the washing (S210), the laundry in the laundry machine is washed using water and a detergent supplied from the outside. During the washing (S210), the drum 20 is rotated in a regular/reverse direction by the driving unit 40, and washing of the laundry is carried out using a difference in elevation and frictional force generated by the rotation of the drum 20.

During the rinsing (S220), water used in the washing (S210) is drained, and then foreign substances and the detergent are removed from the laundry using newly supplied water. During the rinsing (S220), the foreign substances and the remaining detergent are removed also using the difference in elevation and the frictional force generated by the rotation of the drum 20.

During the judging (S230), setting of a dehydrating operation is controlled reflecting the information about the floor, on which the laundry machine is mounted, in the dehydrating (S240), in which the most noise due to the floor is generated. During the judging (S230), the hardness of the floor, input by the user, is compared with predetermined set hardnesses, and the operation of the driving unit 40 is controlled based on the comparison result.

During the dehydrating (S240), water is finally removed from the laundry. Here, the driving unit 40 is controlled according to the kind of the floor, determined during the judging (S230), and thus rotates the drum 20. Dehydration of the laundry in the drum 20 is carried out by the centrifugal force generated by the rotation of the drum 20.

During the washing (S210), the rinsing (220), and the dehydrating (S240), the drum 20 is rotated by the driving unit 40, and a vibration generated from the rotation of the drum 20 may be transmitted to the floor, on which the laundry machine is mounted. That is, force due to the vibration may be continuously applied to the floor during operation of the laundry machine.

In general, the drum 20 is rotated during the washing (S210) and the rinsing (S220) under the condition that a large amount of water is supplied to the drum 20, and the rotational speed of the drum 20 during the washing (S210) and the rinsing (S220) is lower than that of the drum 20 during the dehydrating (S240). Thus, the vibration transmitted to the floor during the washing (S210) and the rinsing (S220) is little.

Therefore, in this embodiment, the judging (230) to reflect the hardness of the floor is applied to the dehydrating (S240). That is, this embodiment describes that the rotational speed of the drum 20 is controlled in consideration of the hardness of the floor during the dehydrating (S240) to adjust the degree of the vibration transmitted to the floor.

However, this method is only one embodiment. In a laundry machine, in which a drum is rotated at a high speed in the washing (S210) and the rinsing (S220), the state of the floor may be judged in an initial operating stage, the drum may be operated in different states in the washing (S220) and the rinsing (S230).

In general, as the rotational speed of the drum 20 is increased, the dehydrating performance of the laundry machine is improved. However, the dehydrating (S240) is carried out while adjusting the rotating state of the drum 20 in consideration of the state of the floor to prevent generation of noise and sagging of the floor.

That is, if the hardness of the floor is more than a set value, the rotating state of the drum 20 may be controlled to reduce noise. On the other hand, if the hardness of the floor is less than another set value, the rotating state of the drum 20 may be controlled to prevent sagging of the floor by continuous transmission of force due to the vibration to the floor.

Here, the controlled rotating state of the drum 20 includes various variables reflected in the rotation of the drum 20, such as a rotational speed of the drum 20, a rotating time of the drum 20, and an acceleration/deceleration of the drum 20.

Hereinafter, a process of carrying out dehydration according to the state of the floor, judged in the judging (S230) will be described.

During the judging (S230), the state of the floor when the laundry machine is mounted on the floor may be directly input to the laundry machine, and the hardness of the floor may be judged using the input state of the floor, Otherwise, a user may input the state of the floor whenever the laundry machine is operated, and the hardness of the floor may be judged using the input state of the floor.

That is, the optimum mode may be selected among various operation modes, which are predetermined, according to the hardness of the floor judged during the judging (S230), and the operation of the laundry machine may be controlled in the selected optimum mode.

In this embodiment, the judging (S230) is carried out prior to the dehydrating (S240), and the operating state of the drum 20 in the dehydrating (S240) is varied according to the hardness of the floor judged in the judging (S230).

In the judging (S230) shown in FIG. 4, the hardnesses of the floor may be classified by a first set hardness and a second set hardness.

A section of the hardness of the floor, which belongs to a range between a first set hardness and a second hardness, means a section of the hardness of the floor not causing noise and sagging of the floor due to vibration while the dehydrating (S240) is carried out.

That is, if the hardness of the floor is more than the first set hardness, the hardness of the floor means that the floor is hard enough to generate excessive noise due to the general operating vibration. On the other hand, if the hardness of the floor is less than the second set hardness, the hardness of the floor means that the floor is soft enough to sag due to the general operating vibration.

Here, the first set hardness and the second set hardness may values obtained by experimentation, and may be varied according to a weight of the laundry machine and a mounted state of the laundry machine.

Hereinafter, with reference to FIGS. 5 to 7, dehydration modes in the dehydrating (S240) according to the hardness of the floor judged in the judging (S230) will be described in detail.

Figure 5:
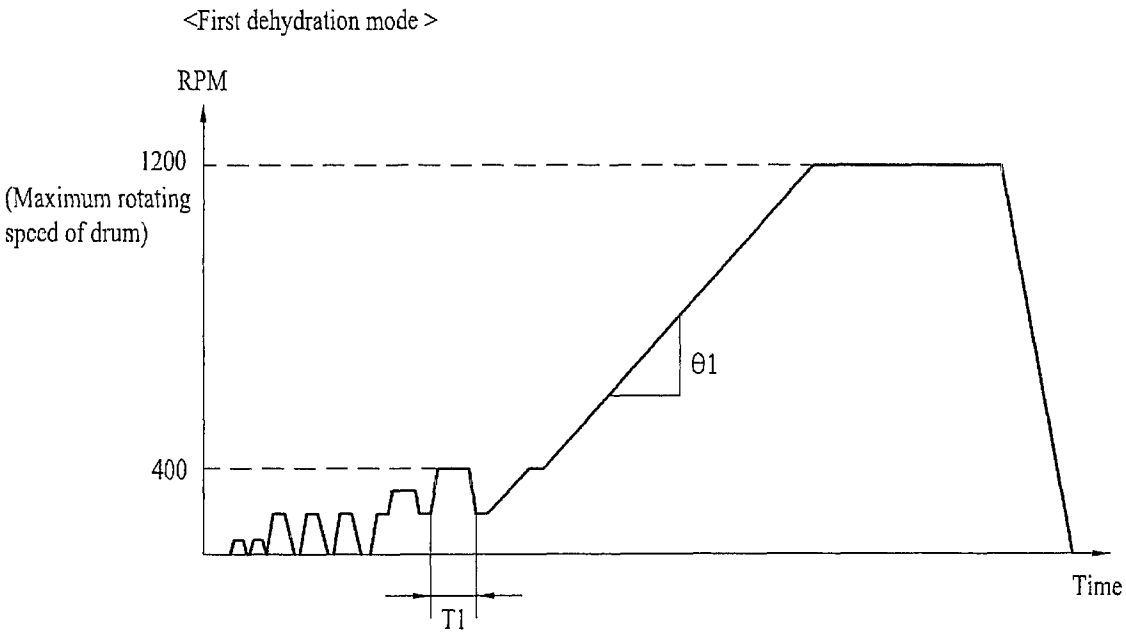
FIG. 5 is a graph illustrating an operating state of the laundry machine in a first dehydration mode of FIG. 3.

If the hardness of the floor corresponds to the range between the first set hardness and the second set hardness in the judging (S230), the dehydrating (S240) is carried out in a first dehydration mode D1 (with reference to FIG. 5).

If the hardness of the floor corresponds to the range between the first set hardness and the second set hardness in the judging (S230), as described above, although the dehydrating (240) is carried out under the general dehydrating operating state, noise and sagging of the floor are not generated. Therefore, the operating state during the dehydrating (S240) in the first dehydration mode (D1) may be similar to the operating state during the general dehydrating.

That is, laundry entanglement and unbalance may be compensated for by repeating rotation and stoppage of the drum 20 in a designated cycle after water in the drum 20 is drained, as shown in FIG. 5. Further, dehydration of laundry received in the drum 20 is carried out while accelerating the rotational speed of the drum 20 to a predetermined maximum rotational speed and then maintaining the maximum speed of the drum 20 for a designated time. As an experimental result in accordance with this embodiment, the maximum rotational speed of the drum 20 in the first dehydration mode D1 is set to about 1,200 RPM in consideration of dehydrating performance and load applied to the driving unit 40.

Here, the acceleration of the drum 20 to the maximum rotational speed may include a process of accelerating the drum 20 to a designated middle rotational speed, maintaining the middle rotational speed of the drum 20 for a designated time T1, decelerating the drum 20, and then re-accelerating the drum 20.

The above process serves to firstly carry out pre-dehydration before the drum 20 reaches the maximum rotational speed, thus minimizing the load applied to the driving unit 40 while the drum 20 is rotated at the maximum rotational speed. As the experimental result in accordance with this embodiment, the middle rotational speed of the drum 20 in the first dehydration mode D1 is set to about 400 RPM.

Here, although the rotational speed of the drum 20 is suddenly changed, since the floor has a sufficient hardness, the acceleration of the drum 20 from the middle rotational speed to the maximum rotational speed or the deceleration of the drum 20 is expressed as a designated tilt angle θ1.

Figure 6:
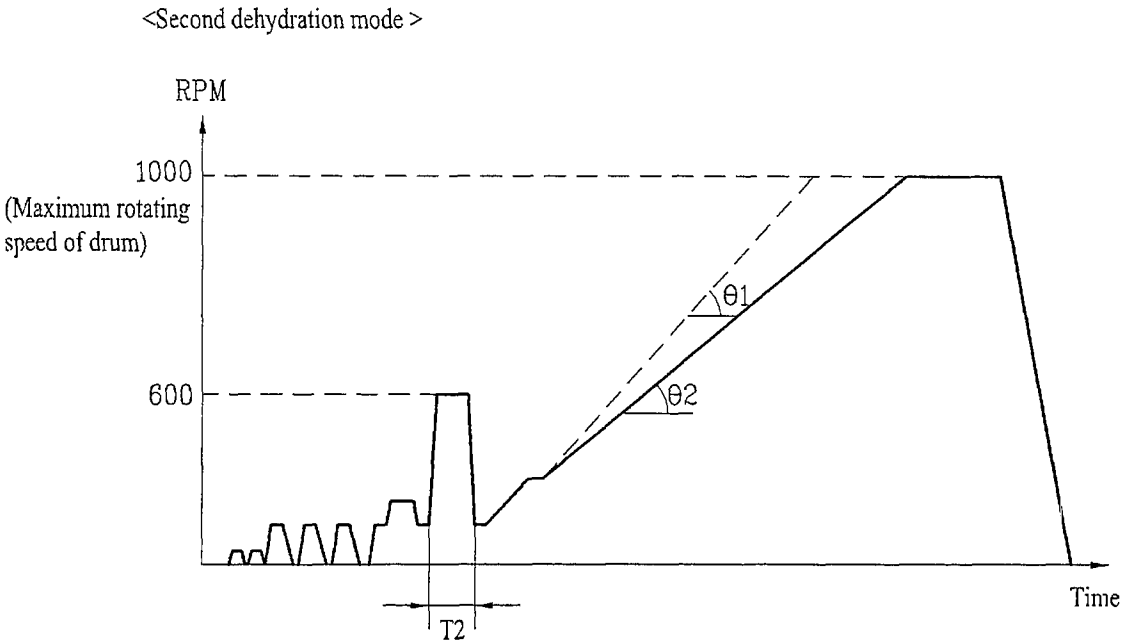
FIG. 6 is a graph illustrating an operating state of the laundry machine in a second dehydration mode of FIG. 3.

If it is judged in the judging (S230) that the hardness of the floor is more than the first set hardness, the dehydrating (S240) is carried out in a second dehydration mode D2 (with reference to FIG. 6).

If the hardness of the floor is more than the first set hardness, as described above, the laundry machine may collide with the floor, thus causing loud noise.

In general, when vibration is transmitted to the floor through the laundry machine, the vibration of a designated degree is absorbed by the weight of the laundry machine, and the adhered state of the laundry machine to the floor is maintained. However, if the floor is excessively hard, i.e., the hardness of the floor is more than the first set hardness, the floor does not absorb even a small vibration, and the laundry machine is separated from the floor and collides with the floor.

Therefore, the operation of the drum 20 in the second dehydration mode D2 may be controlled such that the vibration transmitted through the laundry machine can be minimized.

For example, the rotation of the drum 20 is controlled in the second dehydration mode D2, as shown in FIG. 6. That is, the maximum rotational speed of the drum 20 in the second dehydration mode D2 may be set to a lower RPM than that in the general dehydration mode. Since, as the rotational speed of the drum 20 is increased, a larger vibration is transmitted to the floor, the adhered state of the laundry machine to the floor is maintained by restricting the maximum rotational speed of the drum 20. In this embodiment, through experimentation, the maximum rotational speed of the drum 20 in the second dehydration mode D2 is set to about 1,000 RPM.

Here, the acceleration of the drum 20 to the maximum rotational speed may include a process of accelerating the drum 20 to a designated middle rotational speed, maintaining the middle rotational speed of the drum 20 for a designated time T2, decelerating the drum 20, and then re-accelerating the drum 20.

In this case, since, as a larger amount of water is contained in the drum 20, the vibration transmitted to the floor is increased, the maximum vibration may be transmitted to the floor when the drum 20 reaches the maximum rotational speed, thus causing noise.

Therefore, in the second dehydration mode D2, pre-dehydration may be carried out at the middle rotational speed for the designated time T2, and the middle rotational speed may be controlled such that a large amount of water is drained during the pre-dehydration. In this embodiment, through experimentation, the middle rotational speed of the drum 20 in the second dehydration mode D2 is set to about 600 RPM. Further, in the second dehydration mode D2, an acceleration section and a deceleration section, in which the rotational speed of the drum 20 is changed, are provided. The sudden change of the rotational speed of the drum 20 may influence the degree of the vibration transmitted to the floor. Therefore, the drum 20 in the second dehydration mode D2 may be controlled such that the acceleration or deceleration of the drum 20 may be performed at a gentle tilt angle θ2. That is, the acceleration or deceleration of the drum 20 in the second dehydration mode D2 may be performed more slowly than that in the first dehydration mode D1.

Figure 7:
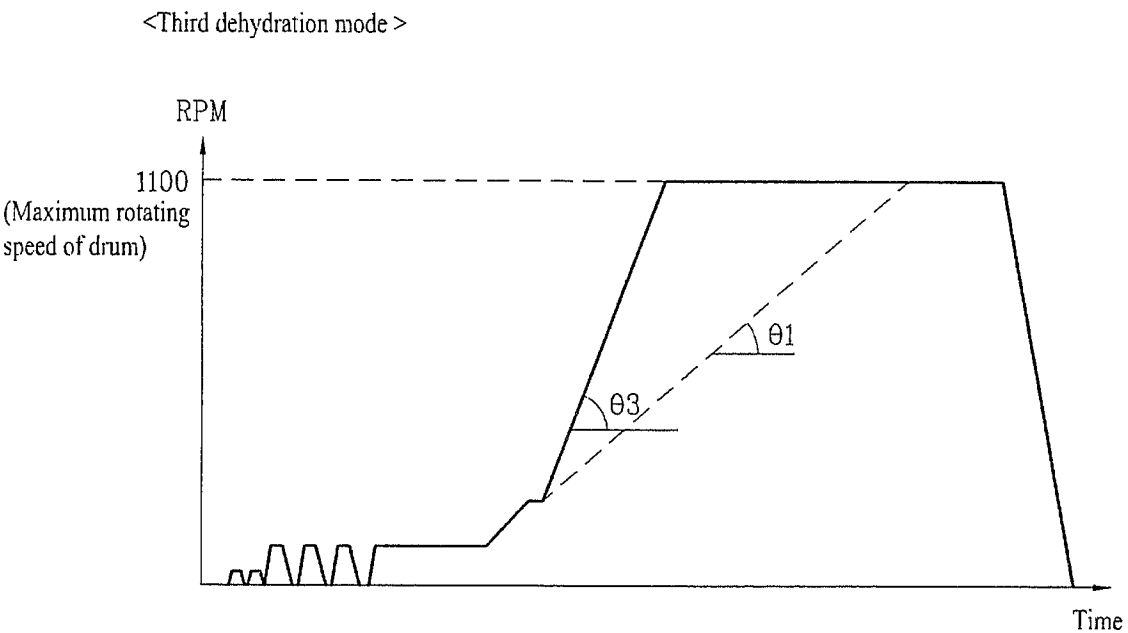
FIG. 7 is a graph illustrating an operating state of the laundry machine in a third dehydration mode of FIG. 3.

Further, if it is judged in the judging (S230) that the hardness of the floor is less than the second set hardness, the dehydrating (S240) is carried out in a third dehydration mode D3 (with reference to FIG. 7).

If the hardness of the floor is less than the second set hardness, as described above, the shape of the floor may be changed and thus the floor may sag due to force transmitted by the laundry machine.

Therefore, the operation of the drum 20 in the third second dehydration mode D3 may be controlled such that the sagging of the floor by the vibration of the laundry machine can be minimized.

For example, as shown in FIG. 7, the maximum rotational speed of the drum 20 in the third dehydration mode D3 may be set to a lower RPM than that in the first dehydration mode D1. Since, as the rotational speed of the drum 20 is increased, a larger vibration is transmitted to the floor, the force transmitted to the floor is reduced by restricting the maximum rotational speed. In this embodiment, through experimentation, the maximum rotational speed of the drum 20 in the third dehydration mode D3 is set to about 1,100 RPM.

The sagging of the floor due to a low hardness of the floor may be influenced by the time to transmit the vibration to the floor as well as the degree of the force transmitted by the vibration of the laundry machine. That is, as the time when the vibration continues is increased, sagging of the floor is increasingly generated.

Therefore, in the third dehydration mode D3 differing from the first and second dehydration modes D1 and D2, a process of maintaining a middle rotational speed of the drum 20 to carry out pre-dehydration may be omitted.

Further, in an acceleration section and a deceleration section, in which the rotational speed of the drum 20 is changed, in the third dehydration mode D3, the drum 20 may be controlled such that the drum 20 is rapidly accelerated and decelerated to shorten the time to transmit the vibration to the floor. Therefore, the drum 20 in the third dehydration mode D3 may be controlled such that the acceleration or deceleration of the drum 20 is performed at a steeper tilt angle θ3 than the tilt angle θ1 in the first dehydration mode D1. That is, the acceleration or deceleration of the drum 20 in the third dehydration mode D3 may be performed more rapidly than that in the first dehydration mode D1.

As described above, in a method of controlling an operation of a laundry machine, dehydrating is selectively carried out according to the hardness of the floor. Although this embodiment describes that the dehydrating is carried out in any one mode among three dehydration modes according to the hardness of the floor, the dehydrating may be carried out in other methods. That is, although this embodiment describes that the operation of the laundry machine is optimally controlled in consideration of state information about the floor, the operation of the laundry machine may be carried out more variously.

In accordance with the present invention, the operation of the laundry machine is carried out optimally according to the state of the floor, thus minimizing noise and sagging of the floor due to vibration.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling an operation of a laundry machine to treat laundry using a rotational force of a drum, comprising:

judging hardness about a floor, on which the laundry machine is mounted; and controlling a rotational speed of the drum according to a hardness about the floor so as to treat the laundry, wherein the control of the rotational speed of the drum is performed upon dehydrating the laundry, wherein, if the hardness is between a first set hardness and a second set hardness, the dehydrating is performed in a general dehydrating operating state, wherein, if the hardness is more than the first set hardness, a maximum rotational speed of the drum is restricted to be less than a rotational speed of the drum in the general dehydrating operating state, and wherein, if the hardness is less than the second set hardness, the maximum rotational speed of the drum is set to be more than the rotational speed of the drum in the general dehydrating operating state and an operating time of the drum is restricted to be less than an operating time in the general dehydrating operating state.

2. The method according to claim 1, wherein if it is determined in the judgment that the hardness about the floor is input by a user, the laundry machine is controlled according to the input hardness about the floor.

3. The method according to claim 1, if it is determined in the judgment that the hardness about the floor are not input, further comprising:

displaying kinds of the floor, on which the laundry machine can be mounted; and waiting for a user's selection out of the displayed kinds of the floor.

4. The method according to claim 1, further comprising rotating the drum at a lower rotational speed than the maximum rotational speed for a designated time prior to acceleration of the drum to the maximum rotational speed.

5. The method according to claim 1, wherein in the judgment of the hardness about the floor, the hardness of the floor is judged using a hardness according to the kind of the floor, which is selected in the initial mounting of the laundry machine.

6. The method according to claim 1, wherein in the judgment of the hardness about the floor, the hardness of the floor is judged using a hardness value according to the kind of the floor, which is input by a user's selection.

* * * * *